US007900381B2

(12) United States Patent
Clymans

(10) Patent No.: US 7,900,381 B2
(45) Date of Patent: Mar. 8, 2011

(54) APPARATUS WITH FLEXIBLY MOUNTED SPUD CARRIAGE

(75) Inventor: Etienne Clymans, Willebroek (BE)

(73) Assignee: Dredging International N.V., Zwijndrecht (BE)

( * ) Notice: Subject to any disclaimer, the term of this patent is extended or adjusted under 35 U.S.C. 154(b) by 151 days.

(21) Appl. No.: 11/921,040

(22) PCT Filed: Jun. 2, 2006

(86) PCT No.: PCT/BE2006/000064

§ 371 (c)(1),
(2), (4) Date: Apr. 16, 2008

(87) PCT Pub. No.: WO2006/130934

PCT Pub. Date: Dec. 14, 2006

(65) Prior Publication Data

US 2009/0126237 A1 May 21, 2009

(30) Foreign Application Priority Data

Jun. 6, 2005 (BE) ..... 2005/0293

(51) Int. Cl.
*E02F 3/00* (2006.01)
*B63B 21/50* (2006.01)
*B63B 21/26* (2006.01)

(52) U.S. Cl. ..... 37/346; 37/307; 37/345; 114/295

(58) Field of Classification Search ..... 37/307, 37/334, 345, 346; 114/293, 294, 295; 405/224–228, 405/196–198; 166/355; 52/155, 65
See application file for complete search history.

(56) References Cited

U.S. PATENT DOCUMENTS

| | | | | | |
|---|---|---|---|---|---|
| 3,003,454 | A | * | 10/1961 | Shatoska et al. | 440/36 |
| 3,601,187 | A | * | 8/1971 | Tidwell | 175/7 |
| 4,033,056 | A | | 7/1977 | Demmers | |
| 4,342,164 | A | * | 8/1982 | Claassen | 37/309 |
| 4,432,420 | A | * | 2/1984 | Gregory et al. | 166/355 |
| 4,646,841 | A | * | 3/1987 | Schawann et al. | 166/355 |
| 5,311,682 | A | * | 5/1994 | Sturdivant | 37/312 |
| 6,817,422 | B2 | * | 11/2004 | Jordan | 166/381 |
| 2008/0251258 | A1 | * | 10/2008 | Bamford | 166/355 |

FOREIGN PATENT DOCUMENTS

| | | | |
|---|---|---|---|
| NL | EP227143 | * | 1/1987 |
| NL | 1011753 | | 12/2000 |

* cited by examiner

*Primary Examiner* — Thomas B Will
*Assistant Examiner* — Abigail A Risic
(74) *Attorney, Agent, or Firm* — Harness, Dickey & Pierce, P.L.C.

(57) ABSTRACT

In one embodiment of the present invention, an apparatus is disclosed for accommodating a substantially vertical spud of a dredging vessel with a longitudinal direction, including a spud carriage which is mounted for limited rotation around a horizontal transverse axis, wherein at least a first and a second spring device is arranged under bias between vessel and spud in the longitudinal direction for the purpose of absorbing a moment on the spud carriage, which first and second spring devices compensate each other in the non-loaded situation of the spud; and at least one spring device is provided with a spring force limiting device for limiting the tension in the spring element from a determined maximum moment on the spud carriage.

11 Claims, 12 Drawing Sheets

APPARATUS WITH FLEXIBLY MOUNTED SPUD CARRIAGE

The present invention relates to an apparatus for accommodating a substantially vertical pole (also referred to as spud) of a dredging vessel, typically a cutter suction dredger, comprising a spud carriage which is mounted for limited rotation around a horizontal transverse axis.

BACKGROUND

Large cutter suction dredgers must often carry out operations at sea or on unsheltered waters. The waves cause the vessel to move and great forces can herein be exited on the couplings between the vessel and the bottom, these couplings being formed mainly by a spud and cutter ladder. These couplings must on the one hand be rigid in order to enable an efficient cutter process, but may not be too stiff because otherwise excessive forces are generated in the spud by the pontoon following the movements of the larger waves.

The invention has for its object to propose an apparatus of the type stated in the preamble which behaves as a spud carriage mounting in the pontoon with a variable rigidity—rigid in the case of small waves and more flexible at critical wave conditions—and in particular with a rigidity which decreases sharply at a determined maximum load of the spud plus spud carriage.

SUMMARY

The invention is distinguished for this purpose in that:

at least a first and a second spring means is arranged under bias between vessel and spud in the longitudinal direction for the purpose of absorbing a moment on the spud carriage, which first and second spring means compensate each other in the non-loaded situation of the spud; and in that at least one spring means is provided with a spring force limiting means which hardly allows the spring force to increase further, whereby the moment generated on the spud carriage around an athwartship axis is limited.

The longitudinal force F1 exerted on the spud is typically a ground reaction force on the point of the spud, and in the case of a cutter suction dredger this normally acts in the direction of the cutter head. This causes a moment on the spud carriage, whereby the spud carriage tilts through a determined angle around the transverse axis, the first spring means is further tensioned and the second spring acting in opposite direction loses tension. This tiltability of the spud carriage in combination with the spring means thus decreases as it were the rigidity and ensures that the moment on the spud carriage is absorbed. When the moment on the spud carriage becomes greater than a determined maximum moment, the spring force then hardly increases further, whereby the moment exerted on the spud carriage around an athwartship axis is limited.

Note that each spring means is typically provided with a spring force limiting means, but that in practice it is only that of the first spring means which will be used often, since a very great longitudinal force F1 will usually occur in only one direction.

According to the preferred embodiment, the first and second spring means are connected by means of respectively a first and second hydraulic cylinder to the vessel for the purpose of applying the desired bias. In this way the bias can be adjusted in a simple manner. In this embodiment the spring force limiting means can be realized in simple manner by means of a piston accumulator which is connected to the bottom side of the hydraulic cylinder. A piston accumulator typically comprises a cylinder with free piston and an accumulator. When the tension in the spring rises above a determined maximum value which is a function of the pressure of the accumulator, pistons of main cylinder and cylinder with free piston move inward, whereby the spring force increases only slowly while the spud carriage rotates. If the force on the spud point is acting in forward direction, the rotation will then be such that the spud point moves forward relative to the vessel, which results in a sharp fall in the force on the spud point. As soon as the force on the spud point becomes smaller than the maximum value, the piston moves outward again under the influence of the accumulator pressure.

According to a further developed variant, spring tensioning means are provided for maintaining a minimum tension in at least the second spring means if the spring means were to completely lose tension and the spring force therein is lost. In the case of a great longitudinal force the first spring means will for instance tension further while the second spring means loses tension, which at a determined limit value of the longitudinal force can result in the spring force being lost completely (in the case the spring means is an elastic wire, this is the point at which the wire becomes slack). This is avoided by using the spring tensioning means.

The spring tensioning means preferably comprise a tensioning plunger arranged in the piston rod of the hydraulic cylinder and an accumulator co-acting therewith. When the force exerted by the spring means on the tensioning plunger falls below a determined value, which depends on the pressure of the accumulator, the tensioning plunger then moves outward and thereby maintains tension in the spring means at a determined minimum.

In the preferred embodiment the first and second spring means are biased first and second wires, preferably steel wires. According to a possible arrangement, the first and second hydraulic cylinders are fixedly connected to respectively a first and second tensioning disc around which the respective first and second wire are guided, which first and second tensioning discs, wires and cylinders are located in a plane perpendicularly of the transverse axis directly opposite each other on respectively a first and second side of the spud carriage. The first (respectively second) wire is for instance guided from a first location on the spud carriage above the transverse axis to a second location on the spud carriage under the transverse axis via the first (respectively second) tensioning disc and one or more guide discs situated on the second (respectively first) side of the spud carriage. In the case of tilting around the transverse axis to the second side the first wire is thus pulled out on either side of the spud, while the second wire slackens on both sides. This therefore forms a symmetrical spring system on either side of the spud carriage above and below the transverse axis. An embodiment of this construction will be discussed in detail with reference to FIG. 3.

In addition, the first and second locations are for instance double discs which are mounted on the spud carriage and along which the first and second wire are guided, and the first (respectively second) wire at an outer end on the first (respectively second) side of the spud carriage and at the other end on the second (respectively first) side of the spud carriage is connected to the vessel.

The invention further relates to an apparatus for accommodating a substantially vertical spud of a dredging vessel, preferably according to any of the foregoing claims, comprising a spud carriage with two slide shoes for guiding the spud carriage over two longitudinal beams, wherein the spud carriage is mounted for limited rotation around a horizontal transverse axis and for limited rotation around a horizontal longitudinal axis. In order to allow this, each slide shoe is fixedly connected to a bush in which a transverse shaft part connected to the spud carriage is received in each case with a determined vertical play. A limited rotatability around a longitudinal axis is after all possible due to this play.

The transverse shaft parts can rotate in the spud carriage and must simultaneously be able to transmit to the spud carriage considerable athwartship forces and moments about an alongship axis of the slide shoe. In a preferred embodiment two spherical bearings are employed for this purpose per transverse shaft part. At least one hydraulic cylinder is preferably arranged in each case between each slide shoe and the spud carriage for the purpose of damping the vertical movement of the transverse shaft parts in the bushes of the slide shoe during tilting around the longitudinal axis. This is the vertical buffer function active during tilting of the spud carriage back from a side to the upright position. During tilting from the upright position to one side the transverse or horizontal buffering is active as specified below. The vertical buffering does of course allow rotation of the spud carriage around a longitudinal axis. In a preferred embodiment each slide shoe is connected for this purpose to the spud carriage by means of two vertical buffer cylinders, one in front of and one behind the rotation point, and the piston volumes and bottom volumes of the two cylinders are connected to each other. The buffering action of the cylinders in the vertical buffering is obtained by connecting the bottom side on the one side to an accumulator via a throttle valve and on the other side to the tank via an overflow valve. The combination of an overflow valve and a throttle valve connected in parallel provides the desired damping.

According to a further developed embodiment, the spud carriage is accommodated via a lower guide and an upper guide in the bin, in each case with a limited horizontal play in the transverse direction, whereby the spud carriage is tiltable in limited manner around a horizontal longitudinal axis, and the upper guide is equipped with means for causing a horizontal buffering during tilting around the longitudinal axis.

According to the preferred embodiment, these horizontal buffer means comprise on each side of the longitudinal axis in a horizontal plane an L-shaped lever with pivot point on the spud carriage, a bumper connected to a first leg of the lever and, connected to the second leg of the lever, a piston of a horizontal cylinder which is connected to the spud carriage in the vicinity of the longitudinal axis. When the spud carriage tilts about a longitudinal axis and moves in the transverse direction toward the bin, the lever provides for outward movement of the piston.

The piston side of the horizontal cylinders is connected on one side via a throttle valve to an accumulator and on the other side via an overflow valve to the tank. The throttle valve and overflow valve connected in parallel provide the desired buffer characteristic or, in other words, for damping of a movement around the horizontal longitudinal axis.

BRIEF DESCRIPTION OF THE DRAWINGS

The invention will be further elucidated on the basis of a number of non-limitative exemplary embodiments with reference to the accompanying drawing, in which.

DETAILED DESCRIPTION OF THE EXAMPLE EMBODIMENTS

Figure 1A:
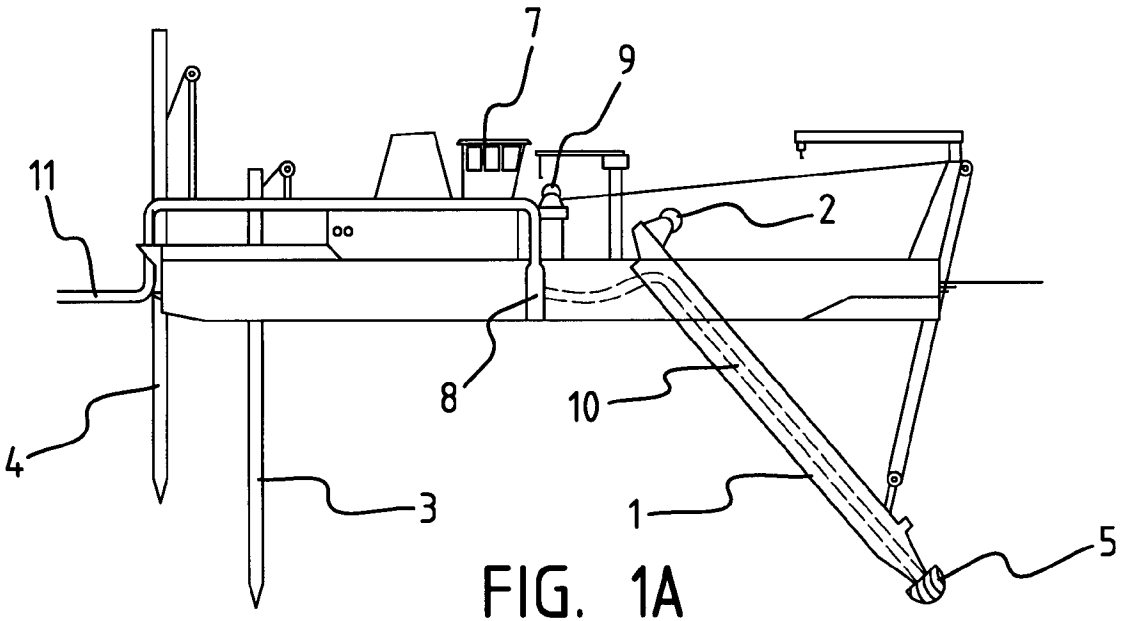
FIG. 1(A) is a side view; and 1(B) a top view of a cutter suction dredger.
Figure 1B:
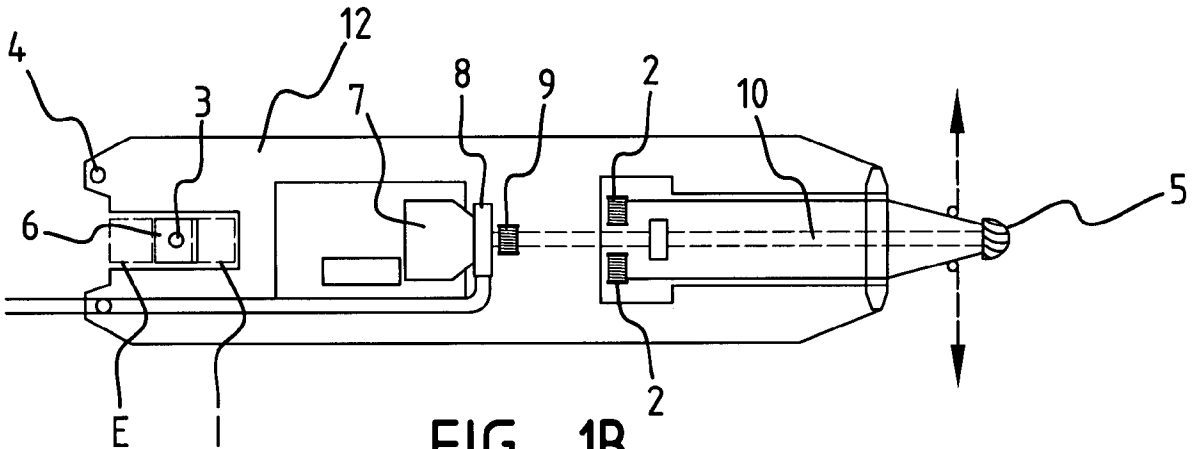

FIG. 1 shows a typical embodiment of a dredging vessel with cutter suction head. The shown vessel comprises, among other parts, a ladder 1, a ladder winch 9 and two side winches 2, an auxiliary spud 4 and a working spud 3 which is accommodated in a spud carriage 6. A cutter head 5 is arranged on the outer end of ladder 1, and suction means are provided close to the cutter head which consist substantially of a suction tube 10 and a pump 8. The vessel further has a control cabin 7, a deck 12 and a pressure line 11 through which the dredged material is discharged.

In such a cutter suction dredger the working spud ensures that a fixed point is formed around which the suction dredger can swing during dredging. Limited steps forward are possible by moving the spud carriage to the rear relative to the vessel, this typically taking place with a cylinder which will be further described with reference to FIG. 2. When working spud 3 is situated in its end position E, a step must be taken using auxiliary spud 4. Auxiliary spud 4 is herein lowered so that it temporarily fixes the vessel relative to the bottom, whereafter the working spud is raised and returned to its starting position I. The working spud is then fixed back into the seabed and the auxiliary spud is raised.

Figure 2A:
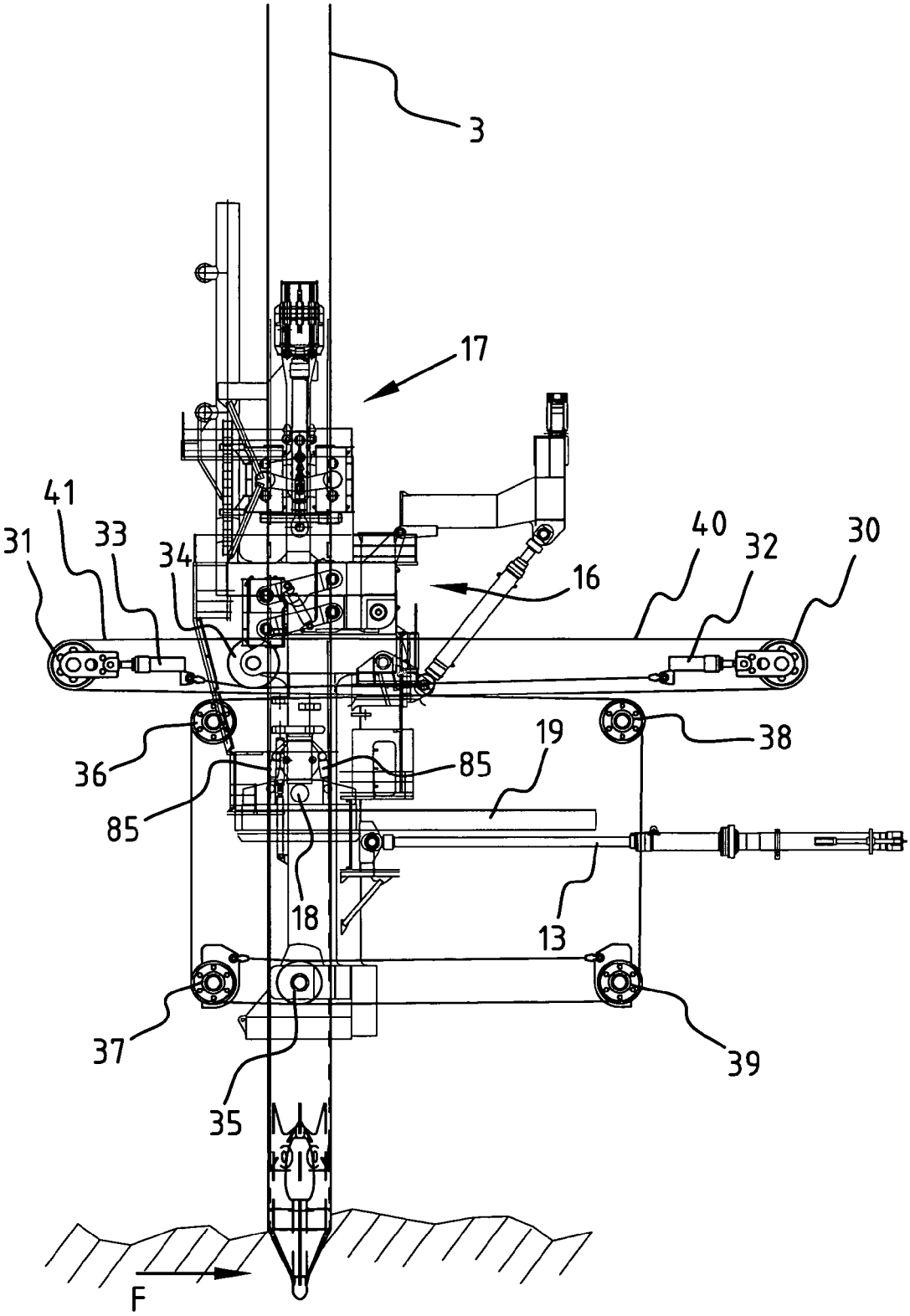
FIG. 2(A) is a side view (in alongship direction) of a possible embodiment of the apparatus according to the invention.
Figure 2B:
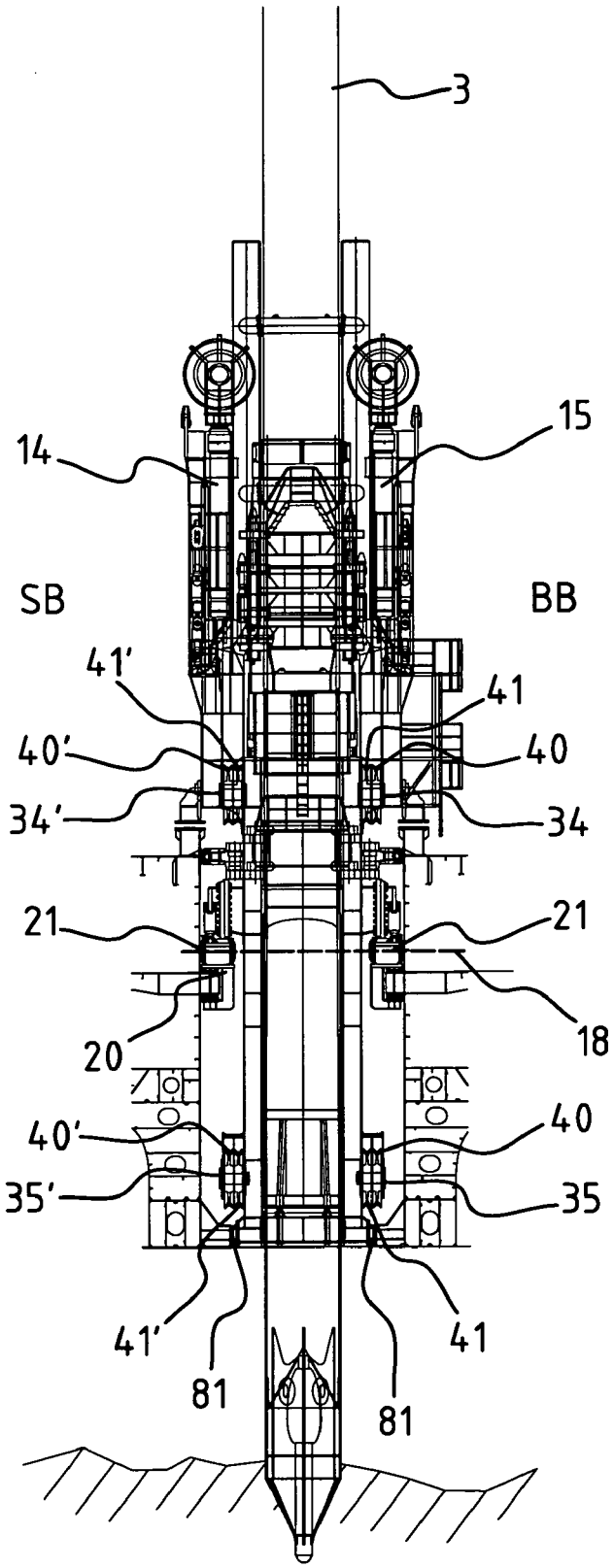
FIG. 2(B) is a front view (in athwartship direction) of a possible embodiment of the apparatus according to the invention.

The apparatus according to the invention will now be further elucidated on the basis of an embodiment variant as shown in FIGS. 2A and 2B. Working spud 3 is accommodated in a spud carriage 6 which is connected to the vessel by means of a horizontal longitudinal cylinder 13. The spud carriage is further provided with a holding catch 16, a lifting catch 17 and two lifting cylinders with disc heads 14, 15. These components enable lifting of the spud, but will not be elucidated here since they do not form part of the present invention.

The spud carriage is provided with two slide shoes 20 which can be guided over two longitudinal guide beams 19 such that the spud carriage is movable horizontally to a limited extent by longitudinal cylinder 13 in the longitudinal direction of the vessel. The spud carriage is further mounted for rotation around a horizontal transverse shaft 18 by means of bushes 21 mounted on slide shoes 20.

Figure 3:
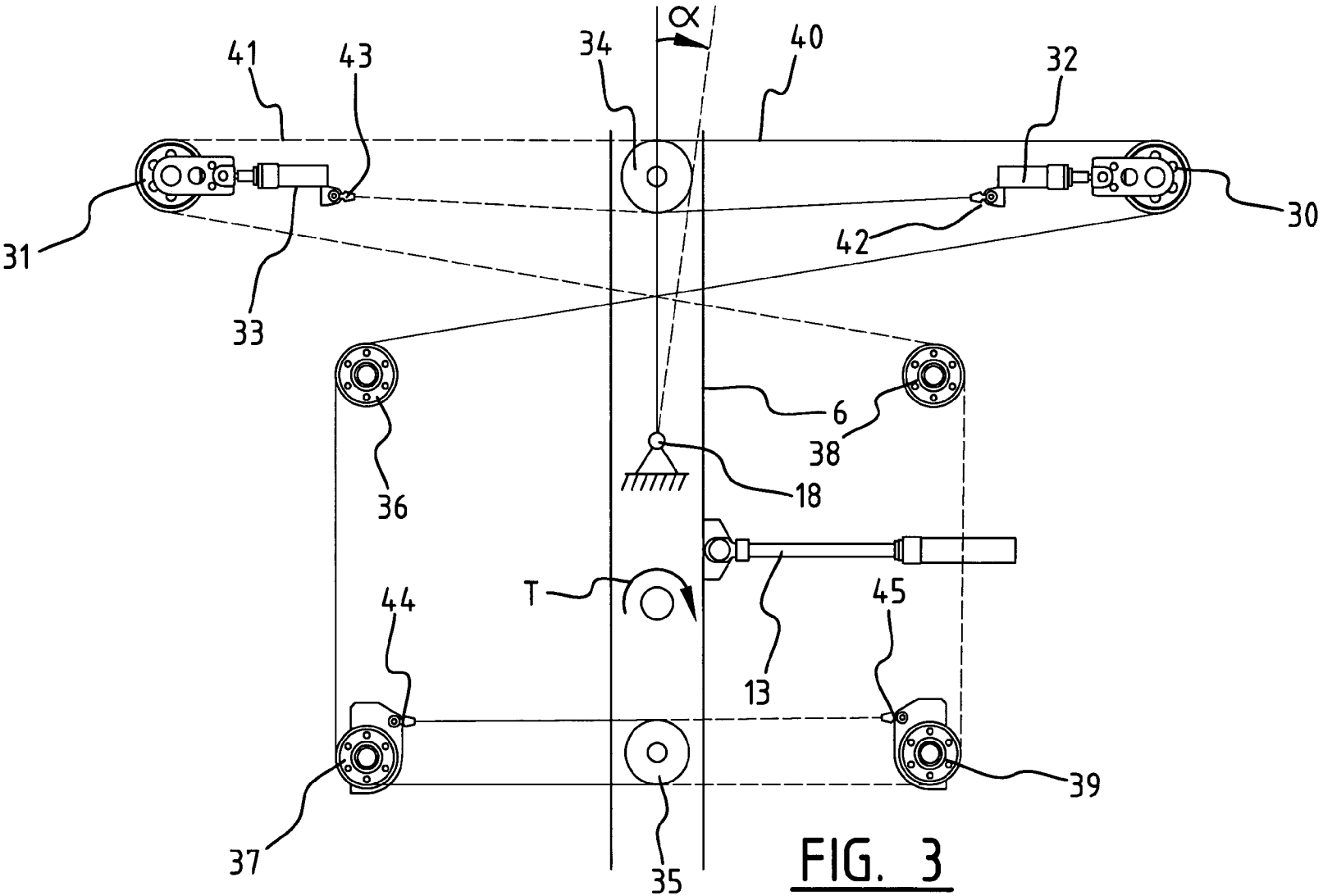
FIG. 3 is a schematic view of the wire system.

The moment M on the spud carriage caused by a longitudinal force F1 is absorbed by a system of steel wires and discs as shown schematically in FIG. 3. A first spring means arranged between the vessel and spud carriage 6 is formed by a first steel wire 40. At one outer end 42 the first steel wire 40 is connected to the vessel to the right of the transverse axis. This first wire 40 is guided via a double disc 34 mounted on the spud carriage to a tensioning disc 30 which also lies to the right of the transverse axis and from where the first wire is further trained diagonally to the other second side of the spud carriage along guide discs 36, 37, and is finally guided over a second double disc 35 mounted on the spud carriage and connected on the other second side, to the left of the transverse axis, to the vessel at the other outer end 44. In similar manner a second wire 41 connected to the vessel at a first outer end 43 forms together with discs 34, 31, 38, 39 and 35 a spring means between spud carriage and vessel which acts in the opposite direction.

Figure 4:
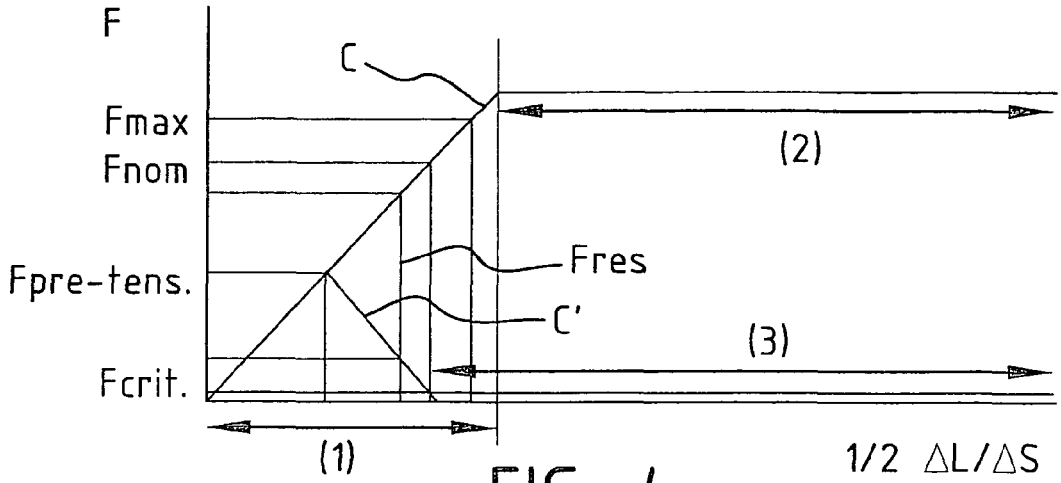
FIG. 4 shows a graph representing the wire tension as a function of the elasticity/2 or of the cylinder displacement.

The first and second wires are held under bias by respectively a first and second hydraulic cylinder 32, 33 which engage respectively on first tensioning disc 30 and second tensioning disc 31. During the dredging process a ground reaction force F1 is typically exerted on the spud point (see FIG. 2A), whereby a spud carriage moment M occurs. As a result of this moment the second wire 41 is stretched elastically, while the first wire 40 loses elastic tension. This is further illustrated by the graph in FIG. 4, wherein the wire load F is plotted as a function of the wire lengthening in range 1, and as a function of the cylinder displacement in range 2. The wire is biased at a force Fv. In range 1 the wire behaves elastically, while in range 2 the wire tension limiting means ensures that the wire does not stretch further. Curve C' shows the wire tension of the wire which slackens. The wire tensioning means (see further) ensure that the wire tension does not fall below determined minimum value Fkrit.

Figure 5:
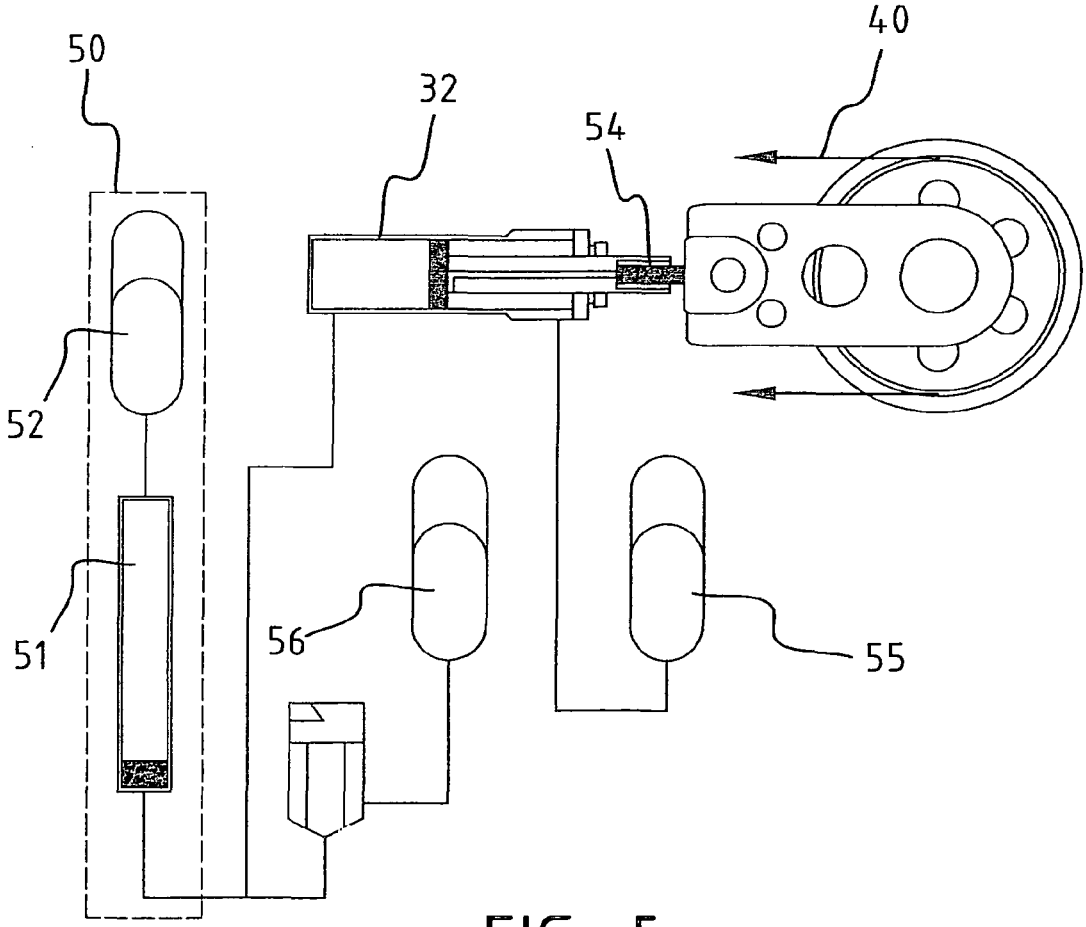
FIG. 5 shows a simplified diagram of a wire tension limiting means and wire tightening means.

Hydraulic cylinders 32, 33 are both provided with a spring force limiting means, and in this embodiment thus a wire tension limiting means which is shown schematically in FIG. 5. The spring force limiting means 50 comprise a piston accumulator constructed from a cylinder with free piston 51 and an accumulator 52. The bottom side of hydraulic cylinder 32 is first brought to the desired pressure, corresponding with the desired bias in the wire, by means of an accumulator 56. When the tension in the wires has reached a determined maximum which depends on the pressure in the piston accumulator, the free piston and the piston of hydraulic cylinder 32 will then move to the left, and the wire tension is in this way limited. When the great wire tension falls away again, the cylinder springs fully outward under the influence of the piston accumulator.

Figure 6:
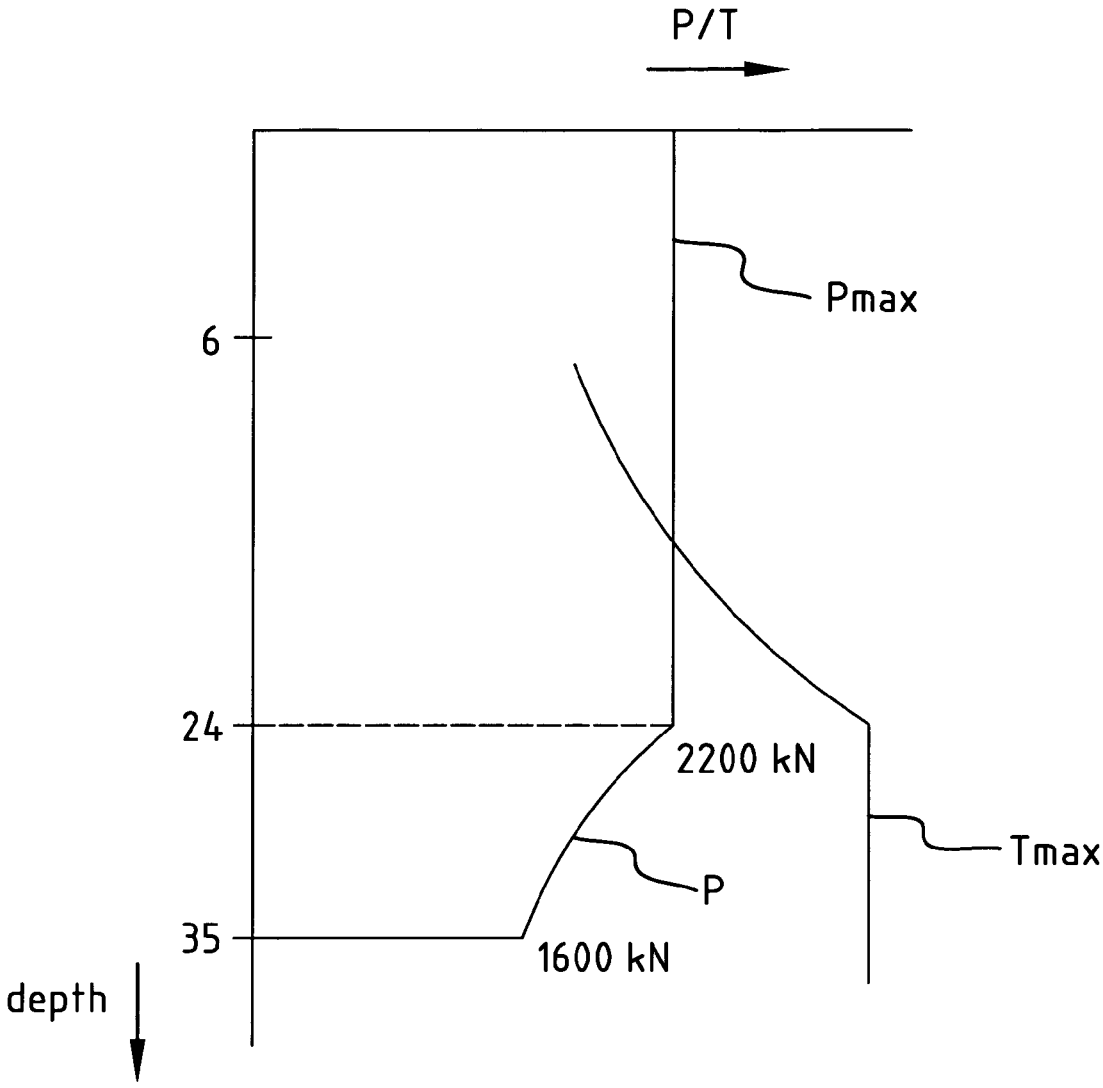
FIG. 6 shows a typical graph for the maximum allowable spud point force P and spud carriage moment M as a function of the depth.

The maximum allowable wire tension is typically a function of the dredging depth. FIG. 6 shows a typical graph for the maximum allowable spud point force P and the associated maximum allowable moment as a function of the depth. For smaller depths the force must be limited to $F_{max}$, this being a design value for the system. For greater depths the spud carriage moment becomes the critical value and the maximum allowed spud force decreases in almost linear manner with the depth. The maximum wire tension in wire 40 is a measure for the maximum spud carriage moment M, and this wire tension can thus be controlled by adjusting accumulator 52 of wire tension limiting means 52 to the appropriate pressure. When the maximum allowed wire tension is reached, the piston moves in the direction of the bottom and the spud carriage can rotate through an additional angle under the influence of the spud force moment around the horizontal transverse axis. Owing to this additional tilting of the spud carriage the reaction force of the ground on the spud will be smaller than if the carriage suspension were to remain rigid. This system therefore limits the spud force moment and the spud point force.

When the wire tension increases in one of the wires, for instance second wire 41, the wire tension in first wire 40 will simultaneously decrease. When a wire tension $F_{NOM}$ is reached in second wire 41 (see FIG. 4), the tension in first wire 40 has fallen to a critical value $F_{KRIT}$, below which value the first wire 40 becomes slack. In order to avoid this there are provided spring tensioning means, here in particular wire tightening means, in order to maintain a minimum tension in the wire. These consist here of a tensioning plunger 54 which is connected to an accumulator 55. With a correct adjustment of the accumulator the tensioning plunger 54 will extend when the wire tension falls below a determined value $F_{KRIT}$.

Note that in the embodiment of FIG. 2 four steel wires are provided, two first and second wires counteracting each other on starboard, and two wires counteracting each other on port, which four wires are each guided along similar disc assemblies 34, 30, 36, 37, 35 (or 34, 31, 38, 39, 35).

Figure 7:
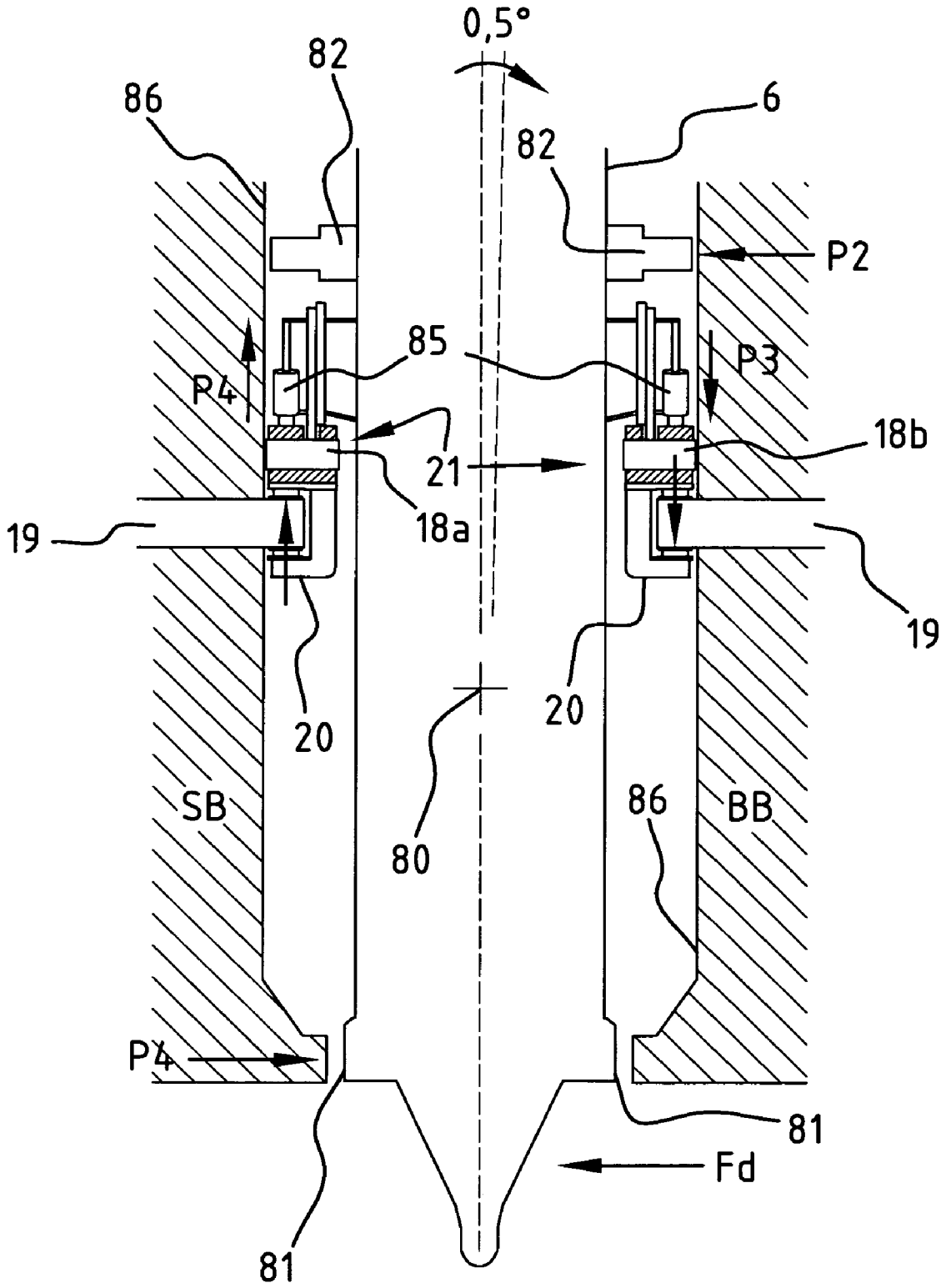
FIG. 7 shows schematically the horizontal and vertical buffering.

FIG. 7 shows schematically the principle of the horizontal and vertical buffering. When spud 3 tilts around a horizontal longitudinal axis 80 under the influence of an athwartship force Fd, in the embodiment from port (BB) to starboard (SB), the following then takes place:

lower guide 81 of spud carriage 6 makes contact on SB with the vessel (see arrow P1);

upper guide 82 of spud carriage 6 is pressed in on BB, whereby a horizontal cylinder 95 on BB (see further in the description of FIG. 8) is extended; on SB the upper guide 82 moves clear of bin 86 of the vessel. When the force Fd drops away, the two cylinders will return slowly to their initial position. This is the horizontal buffering with which the forces between spud carriage and vessel, caused by the athwartship component in the spud force, are kept limited;

on BB the horizontal transverse shaft 18 rests in a bush 21 which is mounted on slide shoe 20 and consequently bears the full weight of the spud carriage. The vertical cylinders 85 on BB are pressed in (see arrow P3);

on SB the vertical cylinders 85 extend (see arrow P4) and thus ensure that slide shoe 20 remains in contact with longitudinal slide beam 19;

when the athwartship force Fd falls away, the spud carriage will return to its initial position wherein the vertical buffer cylinders 85 provide for a damped movement without abrupt contacts. This is the vertical buffering.

Even when the spud carriage is tilted athwartship, it must be able to slide over the longitudinal slide beam. For this purpose the slide shoe must remain over its whole surface in contact with the longitudinal slide beam and not run on an edge (line contact). This "pivoting" is obtained by mounting a (thick) rubber block between the steel construction of the guide shoe and the actual slide element making contact with the longitudinal slide beam.

Figure 8B:
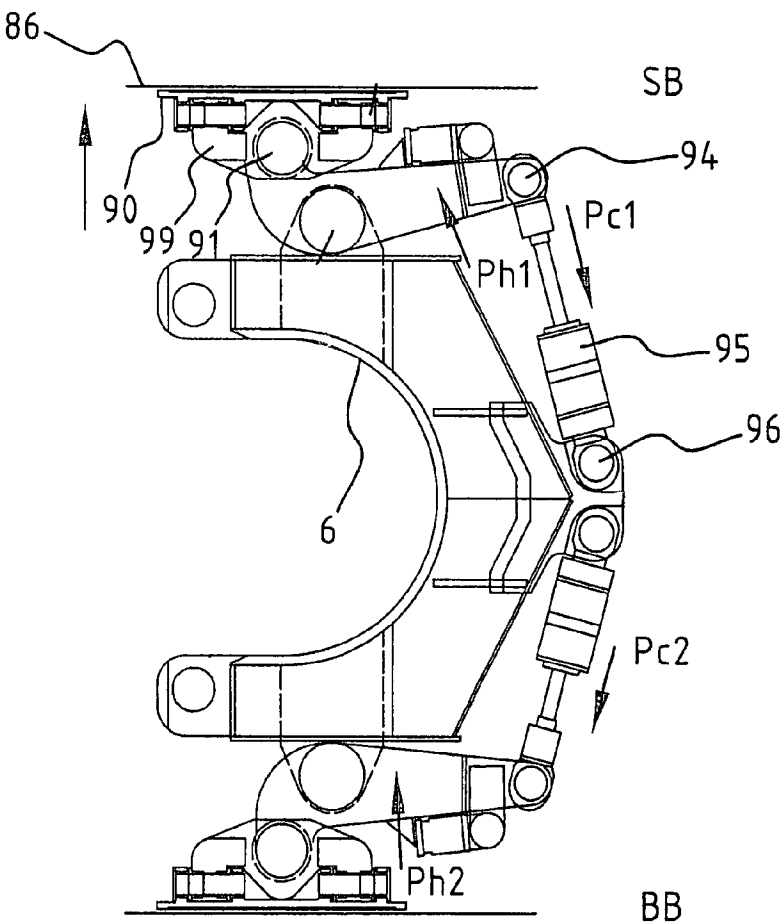
FIG. 8 shows a top view of the upper guide and horizontal or transverse buffering.
Figure 8A:
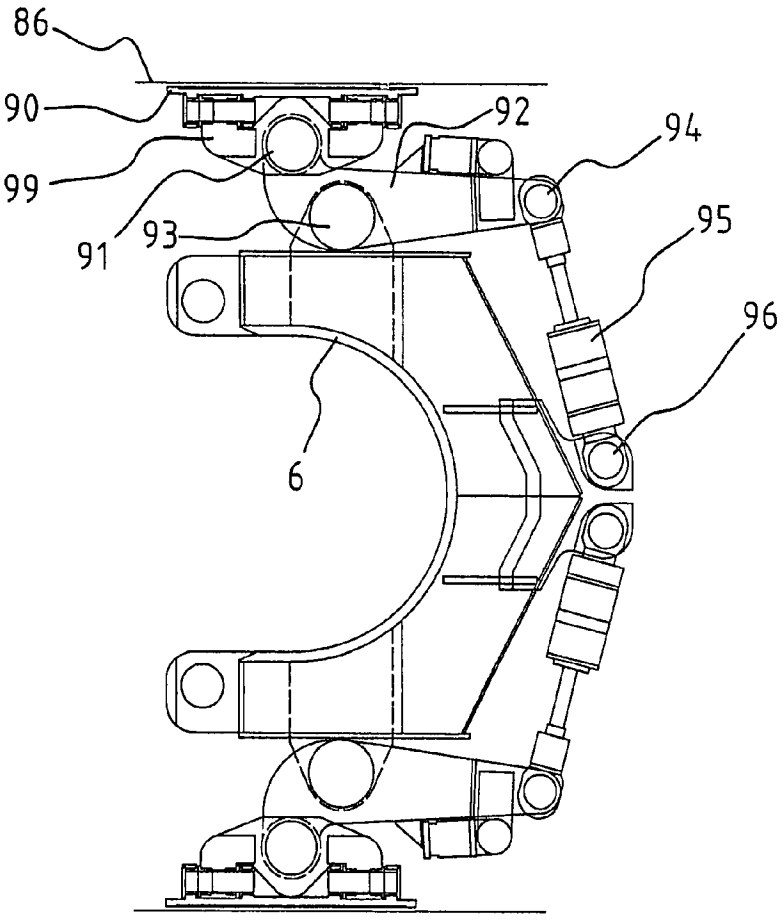
Figure 9:
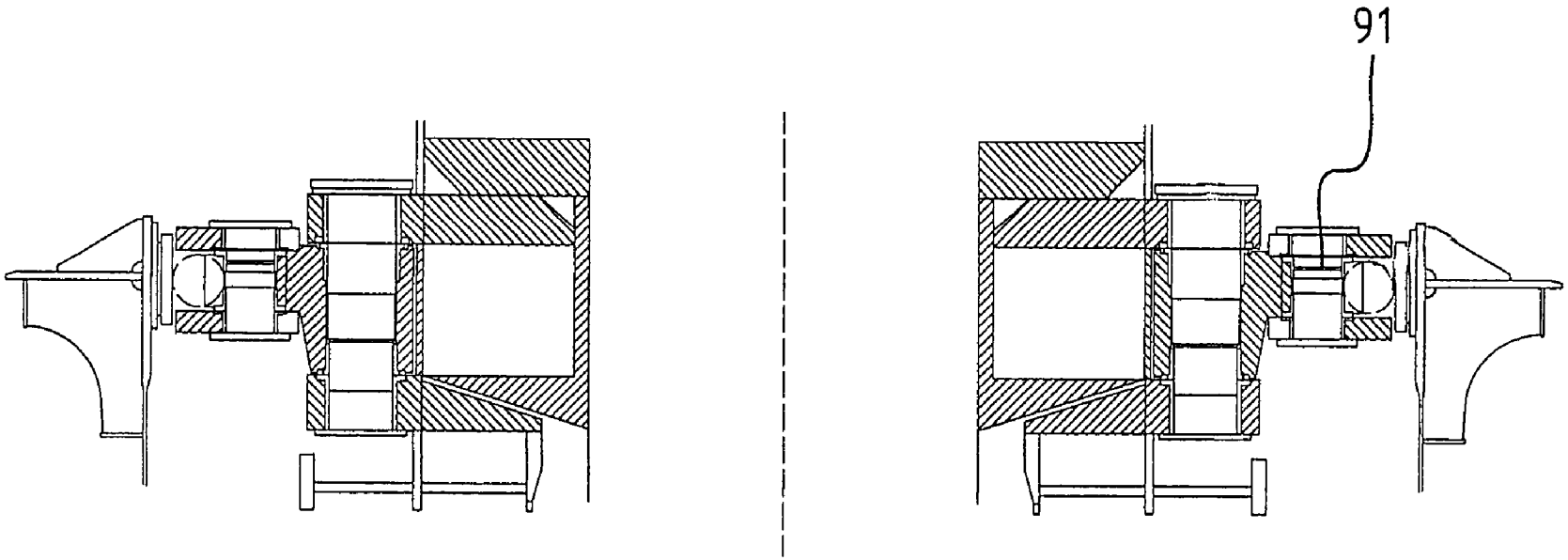
FIG. 9 shows a cross-section of the upper guide and horizontal or transverse buffering.

With reference to FIG. 8(A) the upper guide 82 will now be discussed in detail. On BB and SB the spud carriage is connected for pivoting around a vertical shaft 91 by means of a first arm of a horizontal L-shaped lever 92 to a bumper holder 99 accommodating a bumper 90. The second arm of lever 92 is connected for pivoting around a vertical shaft 94 to one outer end of hydraulic cylinder 95 which is connected on its other end to spud carriage 6 for pivoting around a vertical shaft 96. Bumper holder 99 consists on the one hand of a balanced element which pivots around shaft 91, whereby the bumper presses along the whole length against the upper guide even if the spud carriage were rotated through a small angle about a vertical axis, and consists on the other hand of the holder itself which can rotate around an alongship axis relative to the balanced element, whereby the bumper makes contact along the full height with the longitudinal slide beam even when the spud carriage is tilted to the side.

FIG. 8(B) shows the situation in which the spud carriage is tilted over about 0.5° to SB and the spud carriage moves for instance over 50 mm to SB at the position of the upper guide. The second arm of lever 92 (SB) hereby moves toward bin 86 (arrow PH1) and the piston of cylinder 95 (SB) is extended (arrow PC1), while the second arm of lever 92 (BB) moves away from bin 86 (arrow PH2) and the piston of cylinder 95 (BB) can move inward (arrow PC2).

Figure 10:
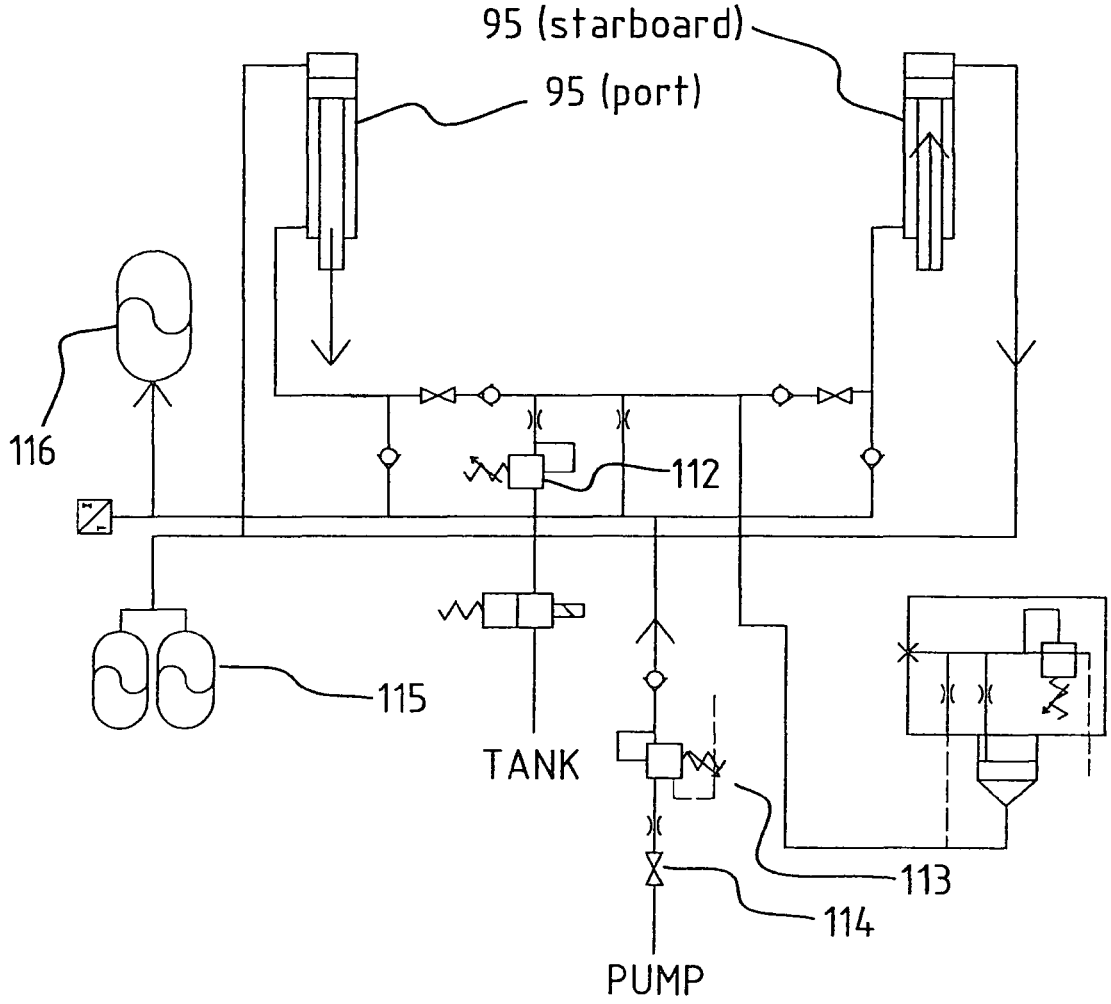
FIG. 10 shows a hydraulic diagram for the cylinders of the transverse buffering.

These cylinders 95 are controlled by a hydraulic circuit which is shown in simplified manner in FIG. 10. The bottom sides of the cylinders are connected in simple manner to an accumulator 115, while the piston sides are connected to an accumulator 116. The pressure in accumulator 116 is lower than in accumulator 115 such that the cylinders are fully pressed in in the non-loaded situation of the spud carriage, and the bumpers always move outward to the maximum and thus make contact with the longitudinal slide beams when the spud is standing upright. With maximum buffering the active cylinder will move further outward than the passive cylinder moves inward, the lack of oil on the bottom side then being compensated by accumulator 115.

This circuit will now be explained assuming that the spud carriage tilts to BB (situation of FIG. 7), wherein the BB cylinder is extended. With a relatively slow movement of the spud carriage, the oil begins to flow from the piston side of cylinder 95 (BB) via throttle valve 110 to the piston side of cylinder 95 (SB) and, when this latter has moved fully inward, to accumulator 116. When the displacement of the spud carriage takes place more rapidly, the pressure drop over throttle-valve 110 will be so great that the oil flows away via overflow valve 112 to the tank. The oil that has flowed away to the tank can be compensated by a pump connected via a pressure-reducing valve 113 to feed conduit 114. Such a hydraulic circuit thus allows effective damping of both large and small athwartship forces and the associated rapid and slow spud carriage rotations around a longitudinal axis.

Figure 11A:
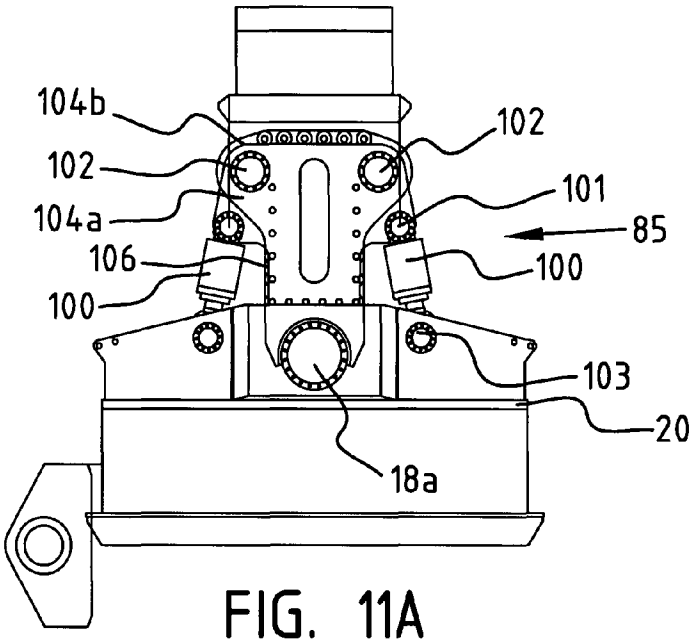
FIG. 11(A) shows a longitudinal view, and (B) a cross-section of the vertical buffer system.
Figure 11C:
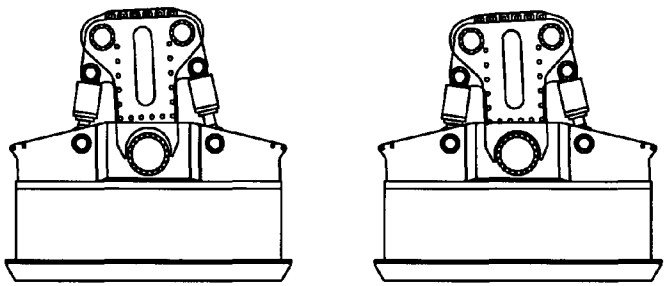
FIGS. 11 (C) and (D) show two possible positions in which the buffer system can be situated.
Figure 11D:
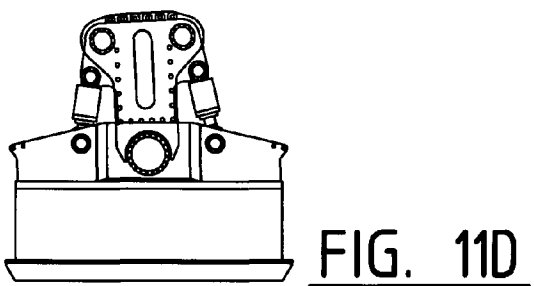
Figure 11B:
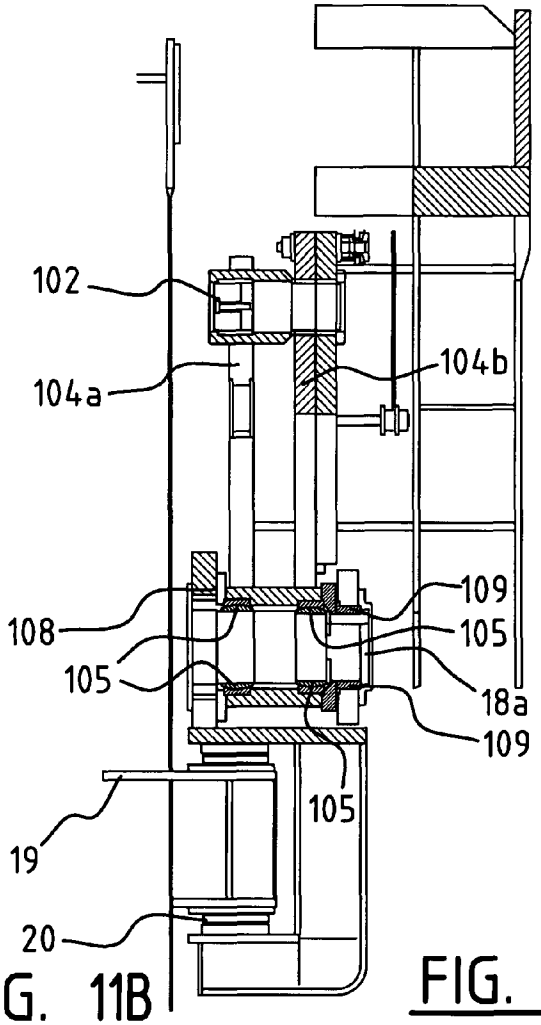

The vertical buffering will now be explained in detail with reference to FIG. 11. As already explained in the description of FIG. 2 above, the spud carriage must be mounted for rotation around a transverse shaft 18 counter to the spring force of the steel wires so as to be able to absorb the alongship forces. In addition, the spud carriage can typically tilt through about 0.5° to BB or SB in order to absorb the athwartship forces. The transverse shaft parts 18*a*, 18*b* on SB and BB must herein be able to move a little upward relative to the rest position, typically over about 50 mm. This is made possible by the use of a particular main bearing as shown in FIGS. 11(A) and (B). The transverse shaft part 18*a* is received at its outer ends with a vertical play of typically about 50 mm in bushes 108, 109 which are fixedly connected to slide shoe 20. For this purpose the transverse shaft parts 18*a*, 18*b* can for instance be flattened on the top or a position of the axis of symmetry relative to the bushes can be chosen 50 mm lower than the position of the axis of symmetry relative to the bearing housing in the spud carrier. The central part of shaft part 18*a* is further received in two spherical slide bearings 105 which are fixedly connected to two vertical middle plates 104*a,b* which are disposed parallel to the slide shoe and are fixedly connected to the spud carriage by means of pins 102 and a series of bolts 106. This arrangement allows athwartship forces on the slide shoes to be transmitted to the spud carriage. The flange 104*a* is connected to slide shoe 20 by means of two cylinders 100 on either side of horizontal transverse shaft 18, wherein the outer ends of the cylinders are connected for pivoting around respective transverse shaft 101 and 103 to respectively middle plate 104 and slide shoe 20.

Figure 12:
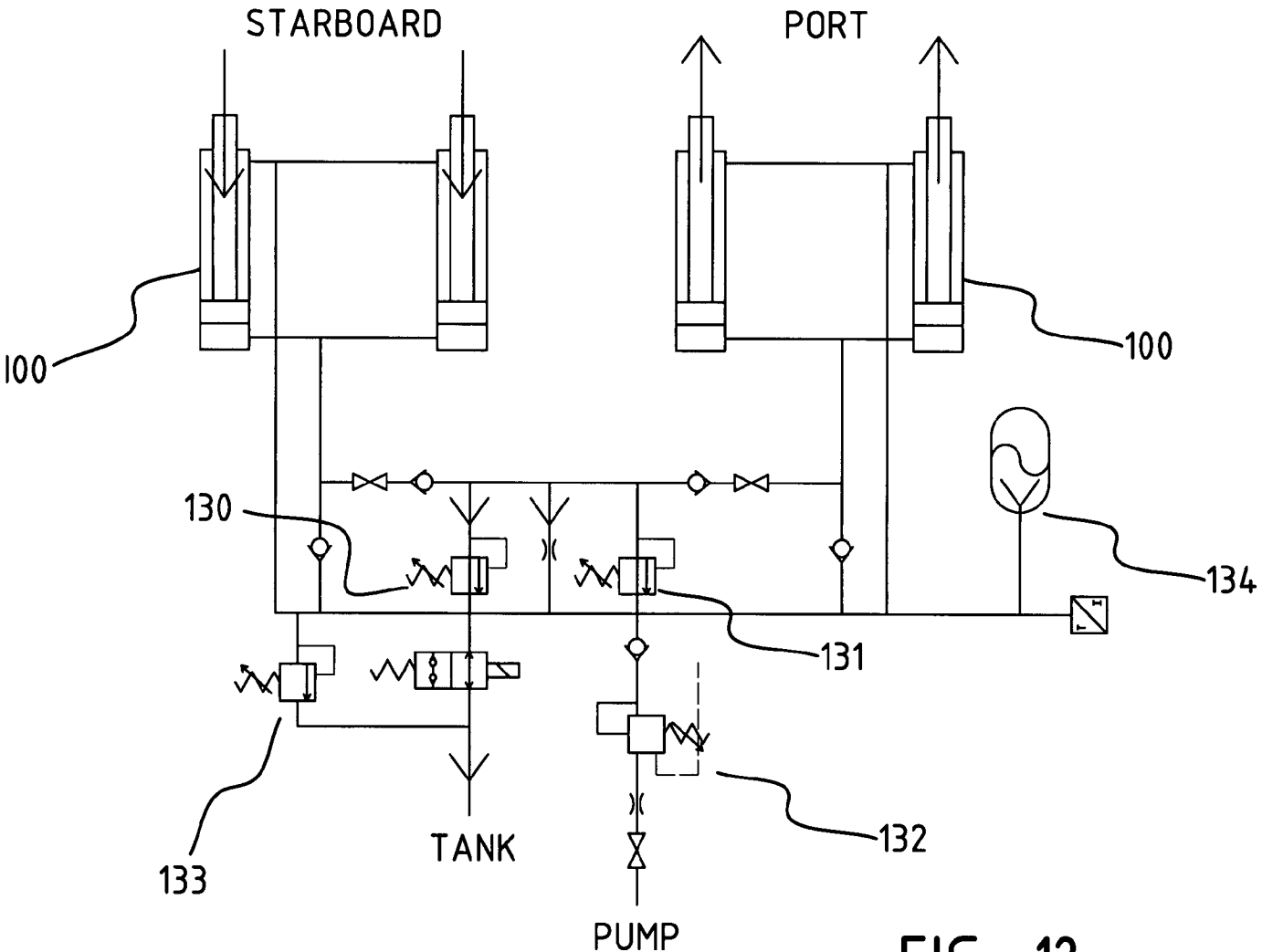
FIG. 12 shows a hydraulic diagram for the cylinders of the vertical buffer system.

The purpose of these vertical buffer cylinders is to limit the force with which shaft parts 18*a*, 18*b* come to lie in the bushes of the slide shoes. This is achieved by controlling the cylinders with the hydraulic circuit shown in FIG. 12.

When the spud carriage tilts back from BB (situation of FIG. 7) to SB, the cylinders on SB then move inward, wherein oil flows by means of throttle valve 135 from the bottom side of the SB cylinders to accumulator 134. If the movement takes place quickly, the pressure drop over the throttle valve will then become so great that the oil flows away over overflow valve 130 to the tank. In both cases energy is destroyed and damping is achieved. Overflow valve 131 protects both cylinders against pressures which are too high. The oil which flows via overflow valve 130 to the tank is carried back into the conduits via reducing valve 132 using a pump. Pressure relief valve 133 protects accumulator 134 against too high a pressure.

The invention is not limited to the above described exemplary embodiments, but on the contrary includes all variants which can be envisaged by an average skilled person, and the scope of the invention is defined solely by the following claims. Finally, the invention can likewise be applied for specific floating islands where the same principle—better bend than break—applies.

The invention claimed is:

1. An apparatus for accommodating a substantially vertical spud of a dredging vessel in a longitudinal direction, comprising:

a spud carriage, mounted for limited rotation around a horizontal transverse axis; and a first spring device and a second spring device, arranged under bias between the dredging vessel and the spud in the longitudinal direction, to absorb a moment on the spud carriage, the first and second spring devices compensating each other in a non-loaded situation of the spud;

wherein at least one of the first and second spring device includes a spring force limiting device to limit tension in said at least one of the first and second spring device from a determined maximum moment on the spud carriage, wherein the first and second spring devices are connected respectively via a first and second hydraulic cylinder to the vessel, to apply the bias.

2. The apparatus as claimed in claim 1, wherein the spring force limiting device includes a piston accumulator, connected to the corresponding hydraulic cylinder.

3. The apparatus as claimed in claim 2, further comprising spring tensioning devices to increase the tension in at least one of the first and second spring device when the spring force therein is lost.

4. The apparatus as claimed in claim 3, wherein the spring tensioning devices include a tensioning plunger arranged in the piston rod of the hydraulic cylinder, and an accumulator co-acting therewith.

5. An apparatus for accommodating a substantially vertical spud of a dredging vessel in a longitudinal direction, comprising:

a spud carriage, mounted for limited rotation around a horizontal transverse axis; and a first spring device and a second spring device, arranged under bias between the dredging vessel and the spud in the longitudinal direction, to absorb a moment on the spud carriage, the first and second spring devices compensating each other in a non-loaded situation of the spud;

wherein at least one of the first and second spring device includes a spring force limiting device to limit tension in said at least one of the first and second spring device from a determined maximum moment on the spud carriage, wherein the first and second spring devices are biased first and second wires.

6. The apparatus as claimed in claim 5, wherein the first and second hydraulic cylinders are fixedly connected respectively to a first and second tensioning disc, around which the respective first and second wire are guided, the first and second tensioning discs being located in a plane perpendicularly of the transverse axis directly opposite each other, on respectively a first and second side of the spud carriage.

7. The apparatus as claimed in claim 6, wherein at least one of the first and second wire is guided from a first location on the spud carriage to a second location on the spud carriage via at least one of the first and second tensioning discs, and one or more guide discs situated on at least one of the second and first side of the spud carriage.

8. The apparatus as claimed in claim 7, wherein the first and second locations are double discs, mounted on the spud carriage and along which the first and second wire are guided, and wherein at least one of the first and second wire at an outer end on at least one of the first and second side of the spud carriage and at the other end on at least one of the second and first side of the spud carriage is connected to the vessel.

9. A cutter suction dredger comprising an apparatus as claimed in claim 1.

10. An apparatus for accommodating a substantially vertical spud of a dredging vessel in a longitudinal direction, comprising:

a spud carriage, mounted for limited rotation around a horizontal transverse axis;

a first spring device and a second spring device, arranged under bias between the dredging vessel and the spud in the longitudinal direction, to absorb a moment on the spud carriage, the first and second spring devices compensating each other in a non-loaded situation of the spud; and spring tensioning devices to increase the tension in at least one of the first and second spring device when the spring force therein is lost, wherein at least one of the first and second spring device includes a spring force limiting device to limit tension in said at least one of the first and second spring device from a determined maximum moment on the spud carriage.

11. The apparatus as claimed in claim 5, wherein the first and second wires are steel wires.

* * * * *